US009663745B2

(12) United States Patent
Leach et al.

(10) Patent No.: US 9,663,745 B2
(45) Date of Patent: May 30, 2017

(54) LAYERED CANDLE ASSEMBLY AND METHODS OF FORMING THEREOF

(71) Applicant: Candle-Lite Company, LLC, Cincinnati, OH (US)

(72) Inventors: Michael Leach, Sardinia, OH (US); Gerald Andy, Hillsboro, OH (US)

(73) Assignee: Candle-Lite Company, LLC, Cincinnati, OH (US)

( * ) Notice: Subject to any disclaimer, the term of this patent is extended or adjusted under 35 U.S.C. 154(b) by 446 days.

(21) Appl. No.: 14/105,576

(22) Filed: Dec. 13, 2013

(65) Prior Publication Data

US 2014/0170578 A1 Jun. 19, 2014

Related U.S. Application Data

(60) Provisional application No. 61/738,566, filed on Dec. 18, 2012.

(51) Int. Cl.
*F23D 3/16* (2006.01)
*C11C 5/00* (2006.01)

(52) U.S. Cl.
CPC ..... *C11C 5/008* (2013.01); *C11C 5/004* (2013.01)

(58) Field of Classification Search
CPC ..... B29C 43/006; B29C 43/18; B29C 39/10; B29C 39/26; B30B 11/04; B30B 11/027
USPC ..... 264/299
See application file for complete search history.

(56) References Cited

U.S. PATENT DOCUMENTS

| | | | | |
|---|---|---|---|---|
| 3,759,478 | A * | 9/1973 | Schmitt | C11C 5/021 249/102 |
| 4,054,636 | A | 10/1977 | Menig | |
| 4,568,270 | A * | 2/1986 | Marcus | C11C 5/002 422/126 |
| 5,395,233 | A | 3/1995 | Karp | |
| 7,637,738 | B2 | 12/2009 | Conover | |
| 7,959,689 | B2 | 6/2011 | Cagle | |
| 2005/0158679 | A1 | 7/2005 | Chen et al. | |
| 2008/0070174 | A1 | 3/2008 | Moeller | |
| 2011/0300496 | A1 | 12/2011 | Cagle et al. | |

FOREIGN PATENT DOCUMENTS

WO WO2011116835 A1 9/2011

* cited by examiner

*Primary Examiner* — Jason Lau
(74) *Attorney, Agent, or Firm* — Frost Brown Todd LLC

(57) ABSTRACT

A method of forming a layered candle assembly includes positioning a candle core in a form. A layer of powdered wax is loaded into the form. The powdered wax layer has an outer region and an inner region. Mechanical force is applied to compress the outer region of the powdered wax layer and form an upper interface surface that is substantially non-horizontal. The outer perimeter of the interface surface is visible to an observer in the finished candle assembly. A liquefied fuel substance is poured over the top of the powdered wax layer to form a layer of solid wax. A wick may be added to at a desirable stage in the method of forming the layered candle assembly. The powdered wax and solid wax layers may each have a color or a combination of colors and/or a scent component or a combination of scent components.

4 Claims, 7 Drawing Sheets

LAYERED CANDLE ASSEMBLY AND METHODS OF FORMING THEREOF

This application claims the benefit of U.S. Provisional Application No. 61/738,566 filed Dec. 18, 2012, entitled "A LAYERED CANDLE ASSEMBLY AND METHODS OF FORMING THEREOF." The entire content of said application is hereby incorporated by reference.

BACKGROUND

Field

The present specification generally relates to candle assemblies, methods of forming candle assemblies and, more specifically, to candle assemblies having at least two layers and methods for making the same.

Technical Background

Candle assemblies and the art of candle making have been common place in many cultures for thousands of years. Generally, a candle assembly is a solid block of wax or some other solidified fuel substance with a wick. The wick, when lit, was used mainly as a source of light, but also provided a source of heat or a method of keeping time. Today, candle assemblies are desired mainly for their decorative look and aromatic properties but are also utilized in religious ceremonies or power outages.

Candles, their designs, and their method of manufacture have changed little over the years and more interesting and aesthetically distinct candle assemblies are needed.

Accordingly, a need exists for alternative candle assemblies and methods of making alternative candle assemblies.

SUMMARY

According to one embodiment, a method of forming a candle assembly includes positioning a candle core in a form, which may be a mold or a freestanding container. The form has at least one sidewall and the candle core is positioned away from the sidewall, creating a space therebetween. A layer of at least one fuel substance in powdered form is then added to the candle assembly. In one embodiment, the powdered fuel substance is powdered wax. The powdered wax layer has an outer region that is closest to the sidewall of the form and an inner region closest to the candle core. The outer region of the powdered wax layer is compressed in an axial direction through the use of a molding tool with a channel and a non-horizontal compression face while the inner region of the powdered wax remains uncompressed such that its density is lower than that of the outer region of the powdered wax layer. The upper surface of the compressed outer region of the powdered wax, known as the interface surface, has a similar non-horizontal pattern. The outer perimeter of the interface surface has the same non-horizontal pattern and is visible to an observer in the finished candle assembly. A liquefied fuel substance is poured over the top of the powdered wax layer to form a layer of solid wax. A wick is added to the candle assembly prior to the addition of the powdered wax, after the compression of the outer region of the powdered wax, or embedded after the pouring of the solid wax layer.

According to another embodiment, the method of forming a candle assembly includes a candle core that may also comprise a channel to allow for the positioning of one or more wicks. In other embodiments, the candle core may be omitted.

According to another embodiment, the method of forming a candle assembly includes a molding tool that is solid and has a non-horizontal compression face such that the outer region and inner region of the powdered wax layer is compressed.

According to another embodiment, the method of forming a candle assembly includes at least one of the powdered wax and solid wax layers having a color. The color of the powdered wax layer may be different from the color of the solid wax layer. The powdered wax layer may also comprise powdered wax with multiple colors such that the powdered wax layer is multi-colored.

According to another embodiment, the method of forming a candle assembly also includes at least one of the powdered wax and solid wax layers having a scent component. The scent component of the powdered wax layer may be different from the scent component of the solid wax layer. The scent component may be fragranced or may exhibit other desired characteristics such as anti-odor, odor-neutralizing, or insect-repelling properties. The powdered wax layer and solid wax layer may also be unscented. The powdered wax layer and solid wax layer may also comprise multiple scent components.

According to another embodiment, the method of forming a candle assembly includes alternating the layers of powdered wax and poured solid wax to achieve a candle assembly with more than two layers.

Additional features and advantages of a candle assembly and its method of manufacture described herein will be set forth in the detailed description which follows, and, in part, will be readily apparent to those skilled in the art from that description or recognized by practicing the embodiments described herein, including the detailed description which follows, the claims, as well as the appended drawings.

It is to be understood that both the foregoing general description and the following detailed description describe various embodiments and are intended to provide an overview or framework for understanding the nature and character of the claimed subject matter. The accompanying drawings are included to provide a further understanding of the various embodiments, and are incorporated into and constitute a part of this specification. The drawings illustrate the various embodiments described herein, and together with the description serve to explain the principles and operations of the claimed subject matter.

DETAILED DESCRIPTION

Figure 1:
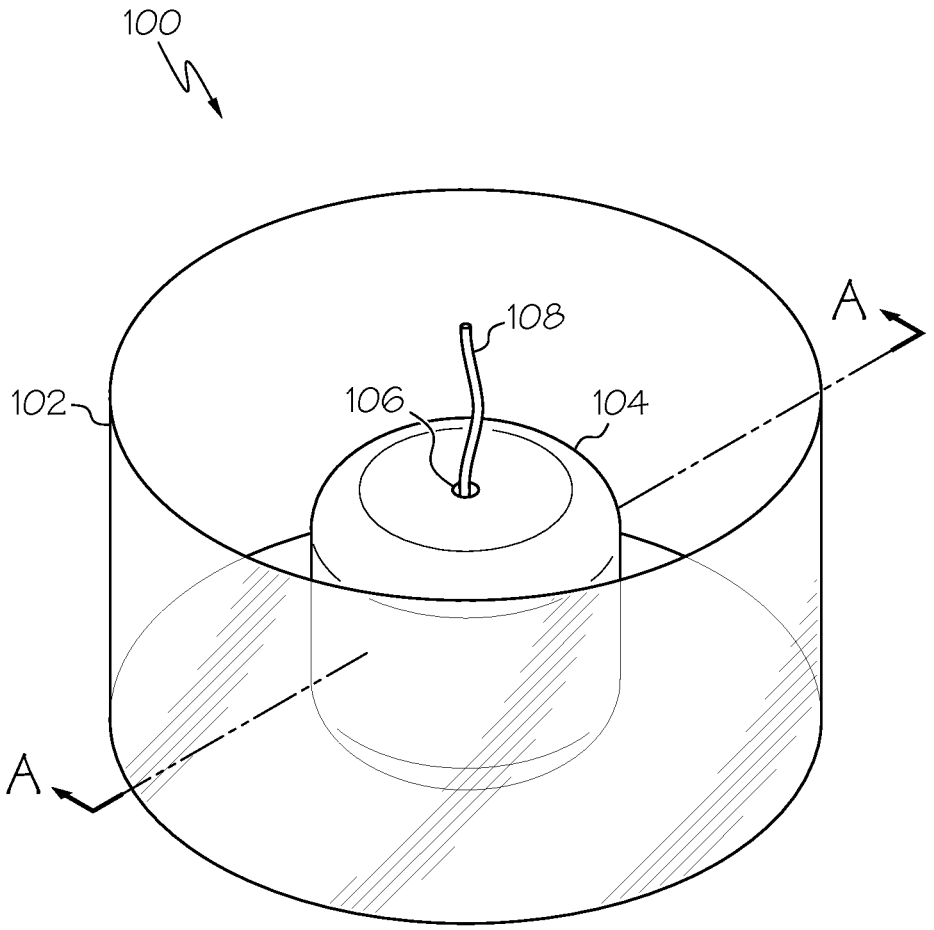
FIG. 1 is a perspective view of a candle assembly with a freestanding container and a centrally positioned candle core according to one or more embodiments shown and described herein.

Reference will now be made in detail to various embodiments of candle assemblies, examples of which are illustrated in the accompanying drawings. Whenever possible, the same reference numerals will be used throughout the drawings and description to refer to the same or like parts. One embodiment of a method of forming a candle assembly is depicted in FIGS. 1-8. In the embodiment illustrated, a candle core is centrally positioned in a form. Powdered wax is loaded into the form to form a powdered wax layer that has an outer region situated closest to the sidewall of the form and an inner region situated closest to the candle core. Mechanical force is applied to compress the outer region of the powdered wax and form an upper interface surface. The interface surface and the outer perimeter of the interface surface are substantially non-horizontal, in that the interface surface and the outer perimeter of the interface surface are not parallel to the bottom of the form. This non-horizontal outer perimeter subsequently forms an interface in the finished candle assembly, the outer perimeter of which is visible to an observer. A liquefied fuel substance is poured over the top of the powdered wax layer to form a layer of solid wax. A wick may be added to the candle assembly prior to the addition of the powdered wax layer, after the compression of the outer region of the powdered wax layer, or embedded after the pouring of the solid wax layer. Methods of forming candle assemblies and the apparatuses used to form candle assemblies will be described in more detail herein.

Figure 2:
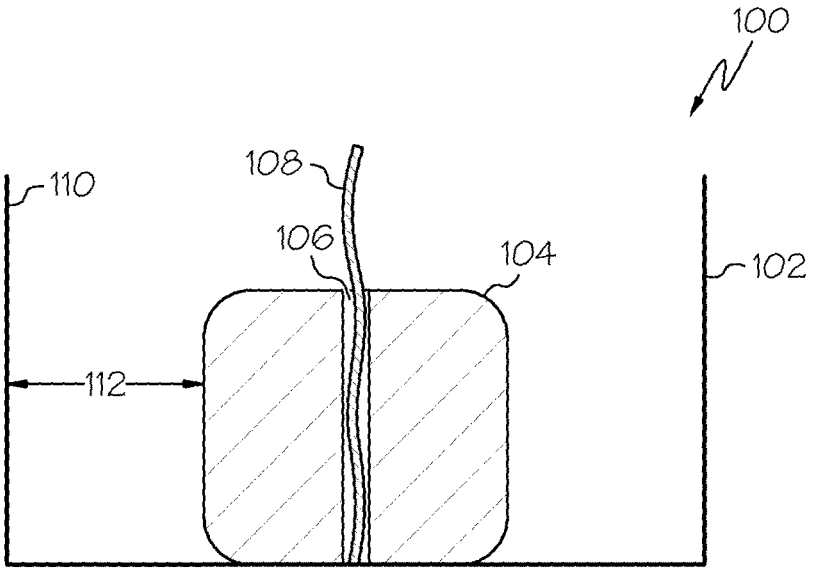
FIG. 2 is a cross-sectional view of the candle assembly of FIG. 1 taken along the line A-A according to one or more embodiments shown and described herein.

Referring to FIGS. 1 and 2, a candle assembly 100 generally comprises a form 102, a candle core 104, and a wick 108. The form 102 is a freestanding container or, in other embodiments, may be a mold. When the form 102 is a freestanding container, the freestanding container may comprise a solid material capable of withstanding compression pressure, including, without limitation, glass, plastic, polymer-based materials, or other suitable materials. In one embodiment, the materials comprising the freestanding container are transparent but, in other embodiments, may be translucent or opaque. The freestanding container may be of any shape suitable for receiving a molding tool including cylindrical, flared, straight-sided, rectangular, multi-sided, or any other shape desired in candle assembly presentation. When the form 102 is a mold, the mold may comprise a solid material capable of withstanding compression pressure, including metal, plastic, and polymer-based, or other suitable mold materials. The mold may be of any shape, including cylindrical, flared, straight-sided, rectangular, multi-sided, or any other shape desired in candle assembly presentation.

Still referring to FIGS. 1 and 2, the candle assembly 100 includes a candle core 104 centrally positioned in the form 102. The candle core 104 may be composed of any suitable fuel substance used in candle construction including, without limitation, paraffin wax, triglyceride wax such as vegetable wax, tallow, soy wax, and the like, beeswax, blends thereof, or any other suitable candle fuel substance. In one embodiment, the candle core 104 includes a channel 106 to accommodate a wick 108. The channel 106 of the candle core 104 may be of a size that allows the wick 108 to be threaded through and supported by the candle core 104. In some embodiments, the channel 106 of the candle core 104 may accommodate multiple wicks 108. Alternatively, the candle assembly 100 may be formed without a candle core 104. In yet another embodiment, the candle assembly 100 may include one or more candle cores 104 to accommodate a similar number of wicks 108.

The wick 108 may be composed of any suitable material including, without limitation, cotton, rayon, nylon, hemp, wood, blends thereof, or other suitable wick materials. The wick 108 may be of any shape and/or construction including woven, braided, flat, square, round, cylindrical, or any other suitable wick shape and/or construction. The wick 108 may also include a wick core to help support the wick 108 as the candle assembly 100 burns. The wick core may be composed of, without limitation, any suitable material including cotton, metal, paper, polyethylene fiber, or any other suitable materials. The wick 108 may be tailored to the specific composition of the remainder of the candle assembly 100, as detailed below.

In one embodiment, the wick 108 is threaded through the channel 106 of the candle core 104 and coupled with a wick clip. In another embodiment, a pin may be inserted in place of the wick 108 so that the wick 108 may be added at a later step in the process of forming the candle assembly 100. The candle assembly 100 includes one single wick 108 but, in other embodiments, may include a plurality of wicks 108 threaded through a similar number of candle cores 104. The candle assembly 100 may also include a plurality of wicks 108 threaded through a single candle core 104.

Figure 3:
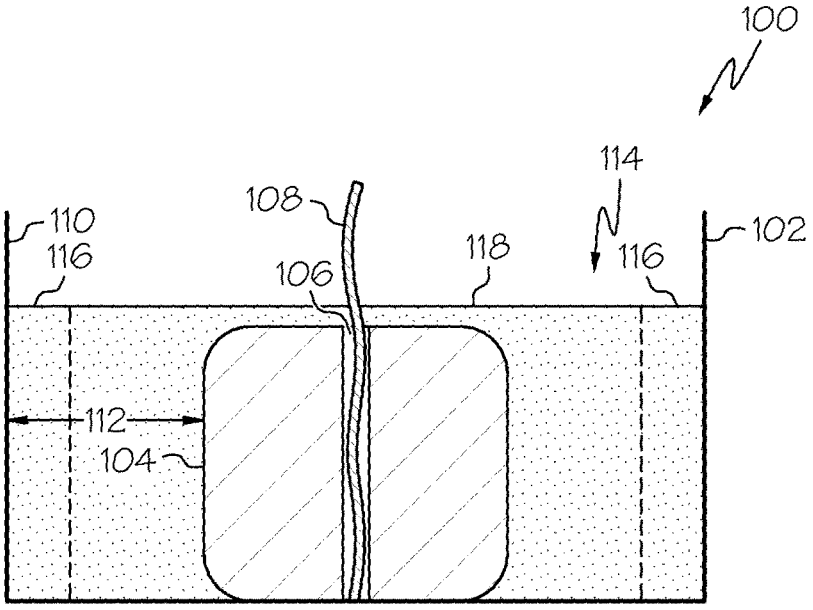
FIG. 3 is a cross-sectional view of a candle assembly of FIG. 2 with a freestanding container, centrally positioned candle core, and a powdered wax layer prior to compression of the outer region of the powdered wax layer according to one or more embodiments shown and described herein.

Referring now to FIGS. 2 and 3, a candle core 104 is schematically depicted centrally positioned in a form 102. The form 102 has at least one sidewall 110. Alternatively, the candle core 104 may be positioned at any desirable location in the form 102 such that the candle core 104 is spaced apart from the sidewall 110. In one embodiment, the candle core 104 is placed in the form 102 such that there is a space 112 between the candle core 104 and the sidewall 110 of the form 102.

Referring now to FIG. 3, the space 112 between the candle core 104 and the sidewall 110 is filled with the powdered wax layer 114 to at least partially obscure the candle core 104 from view. In one embodiment, the powdered wax layer 114 is loaded into the form 102 in the space 112 and is distributed to completely surround the candle core 104 and occupy the space 112 between the candle core 104 and the sidewall 110 of the form 102. The powdered wax layer 114 has an outer region 116 situated closest to the sidewall 110 of the form 102 and an inner region 118 situated closest to the candle core 104 (i.e., the inner region 118 is radially inward from the outer region 116).

Still referring to FIG. 3, the powdered wax layer 114 is composed of small, discrete particles of a solid fuel substance such as, without limitation, paraffin wax, triglyceride wax such as vegetable wax, tallow, palm wax, soy wax, coconut oil wax, stearic acid, palmetic acid, blends thereof, or any other suitable powdered fuel substance. The powdered wax layer 114 generally has a melting point in the range of 320 K to 340 K. In one embodiment, the melting point of the powdered wax layer 114 is 320 K. The powdered wax layer 114 may optionally have a first color or a first combination of colors and a first scent component or a first combination of scent components incorporated into the particles that form the powdered wax layer 114. The particles of the powdered wax layer 114 may be formed through the use of a spray drum, cooling tower, extrusion, fluidized bed, or other suitable method. The powdered wax layer 114 may include particles of various shapes, including flakes, spheroids, beads, ribbons, pastilles, or other suitable shapes. In one embodiment, the powdered wax layer 114 is comprised of spherical particles with an aspect ratio of 1. In other embodiments, the powdered wax layer 114 may comprise particles which have an aspect ratio greater than 1. The particles of the powdered wax layer 114 may range in size from 250 μm to 2 mm.

Figure 4:
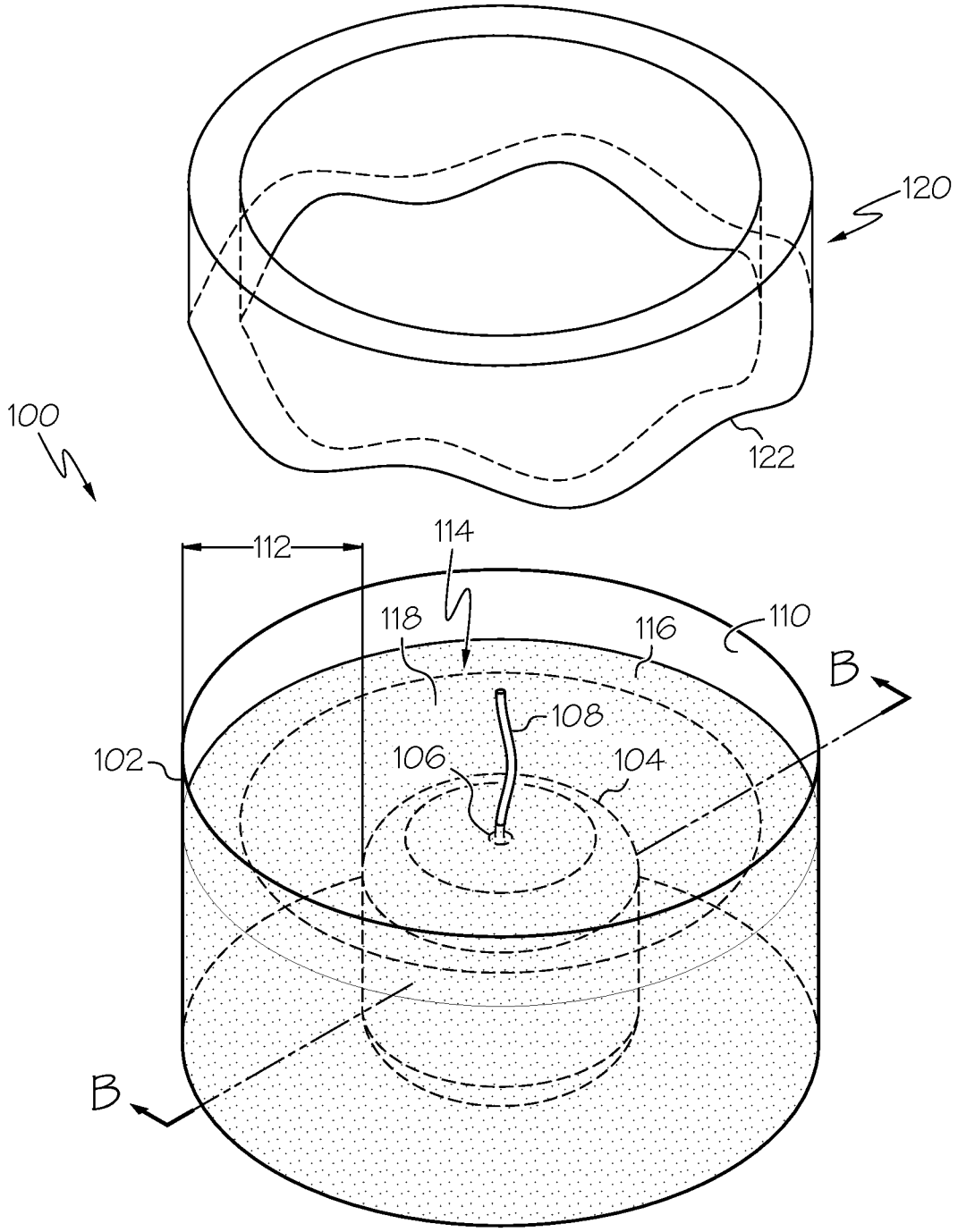
FIG. 4 is a perspective view of a candle assembly of FIG. 3 with a molding tool positioned above the candle assembly according to one or more embodiments shown and described herein.
Figure 5:
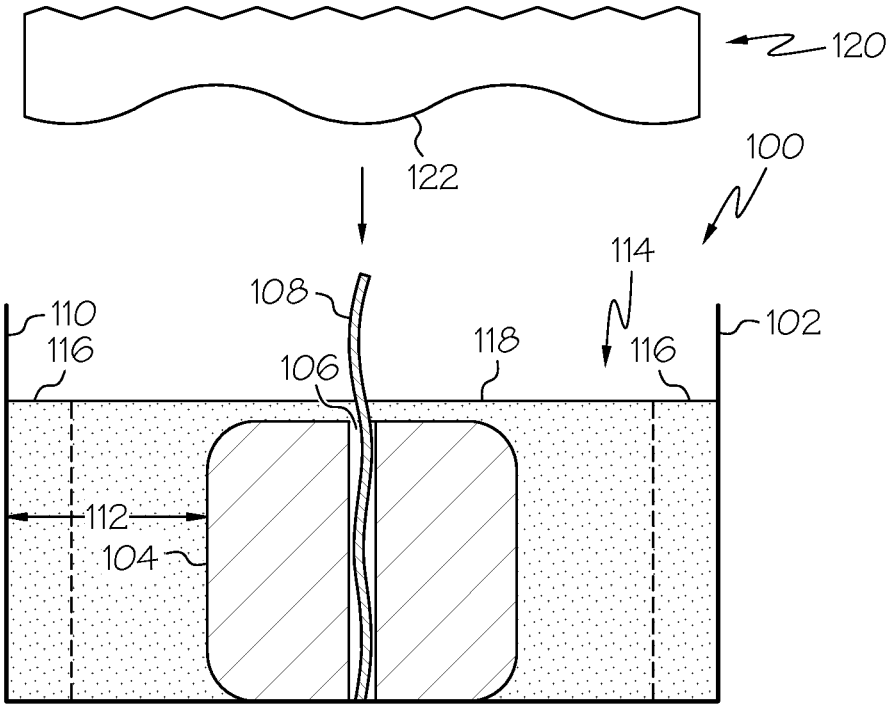
FIG. 5 is a cross-sectional view of the candle assembly of FIG. 4 taken along the line B-B with a molding tool about the engage the candle assembly according to one or more embodiments shown and described herein.

Referring now to FIGS. 4 and 5, the outer region 116 of the powdered wax layer 114 is compressed through the use of a molding tool 120. The molding tool 120 has a compression face 122 that contacts the outer region 116 of the powdered wax layer 114. The compression face 122 has a patterned, wavy, angled, zig-zagged, or other non-horizontal pattern, which is subsequently imparted to the outer region 116 of the powdered wax layer 114. The non-horizontal pattern is one that is entirely non-horizontal when compared to the horizontal plane of the candle assembly 100 or, alternatively, contains one or more segments that deviate from parallel with the horizontal plane. The molding tool 120 may be formed from plastic, metal, polyvinyl chloride, wood, rubber, polyurethane, or any other suitable material. In the embodiment described herein, the molding tool 120 generally corresponds to the internal shape and internal dimensions of the form 102. In one embodiment, the molding tool 120 is coupled to a compression ram. In another embodiment, the molding tool 120 may be driven manually. Alternatively, the molding tool 120 may be driven mechanically, electro-mechanically, hydraulically, pneumatically or by any other suitable actuation mechanism. In the embodiment described herein, the molding tool 120 includes a channel or bore to accommodate the wick 108 and/or candle core 104 and thereby avoid compression of the wick 108, candle core 104, and/or inner region 118 of the powdered wax layer 114. In other embodiments, if a wick 108 and/or candle core 104 is not present prior to compression of the powdered wax layer 114, the molding tool 120 may be solid. In one embodiment, the molding tool 120 is suitably constructed to deliver around 40 kPa of applied pressure. However, the amount of applied pressure may be adjusted depending on the desired look of the finished candle assembly 100.

Figure 6:
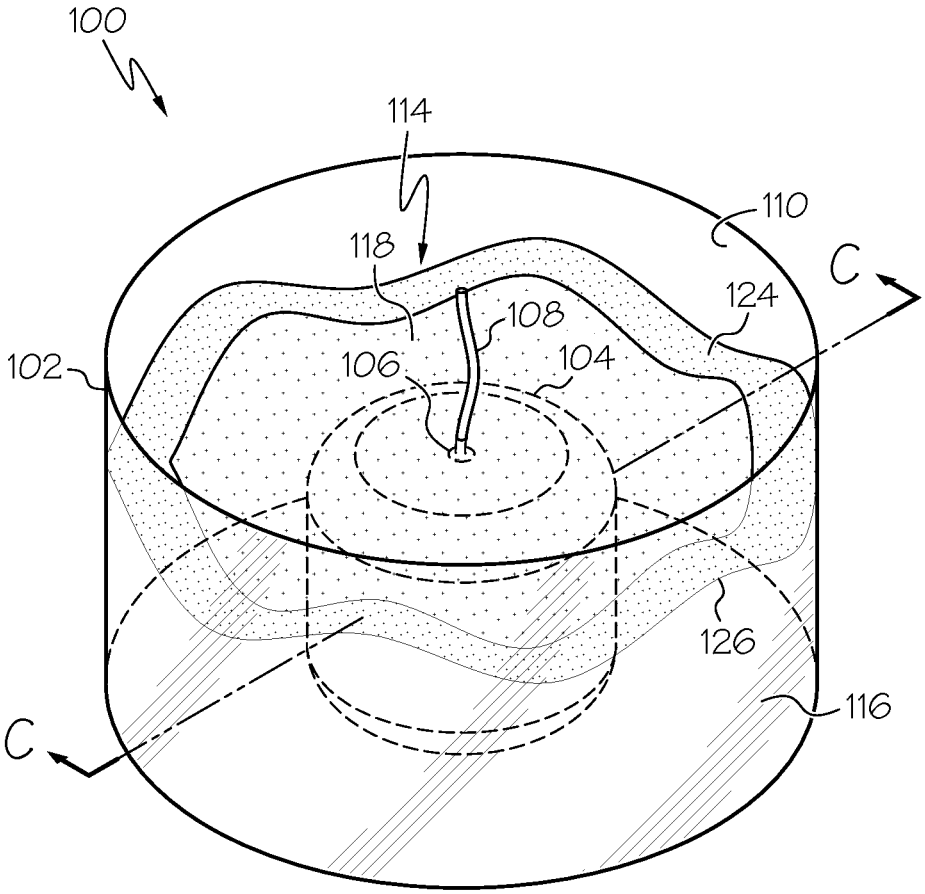
FIG. 6 is a perspective view of the candle assembly of FIG. 5 after the outer region of the powdered wax layer has been compressed according to one or more embodiments shown and described herein.

Referring now to FIG. 6, the candle assembly 100 is depicted after the compression face 122 of the molding tool 120 has contacted and compressed the outer region 116 of the powdered wax layer 114, thereby forming an interface surface 124 on the upper surface of the outer region 116. Following compression, the interface surface 124 exhibits a complimentary pattern to that of the compression face 122, which is wavy. In other embodiments, the interface surface 124 may be patterned, angled, zig-zagged, or some other non-horizontal pattern. In addition, the outer perimeter 126 of the interface surface 124 closest to the sidewall 110 of the form 102 also exhibits a complimentary pattern to that of the compression face 122 following compression. The pattern of the interface surface 124 and, more specifically, the outer perimeter 126 of the interface surface 124, creates a visible, non-horizontal interface between the powdered wax layer 114 and subsequent layers added to the candle assembly 100. In this embodiment, the molding tool 120 has a channel 106 for accommodating the candle core 104 and the inner region 118 of the powdered wax layer surrounding the candle core 104 and, as such, the inner region 118 of the powdered wax layer 114 remains uncompressed. Accordingly, it should be understood that, after compression, the outer region 116 of the powdered wax layer 114 has a greater density than the inner region 118 of the powdered wax layer 114. Moreover, because the inner region 118 is not compressed, the height of the inner region 118 from the bottom of the form 102 may be greater than the height of the outer region 116 from the bottom of the form 102. In one embodiment, the cross-sectional width of the outer region 116 is substantially equal to the cross-sectional width of the compression face 122 of the molding tool 120.

Still referring to FIG. 6, after the compression of the outer region 116 of the powdered wax layer 114, the candle assembly 100 may be mechanically manipulated to dislodge any errant powdered wax particles from the sidewall 110 of the form 102. In one embodiment, the candle assembly 100 is then heated to achieve a desired look, further smooth the interface surface 124, and/or melt errant particles of the powdered wax layer 114 on the sidewall 110 of the form 102 such that the melted particles of the powdered wax layer 114 will be miscible with the later step of adding a solid wax layer 128 to the candle assembly 100. The surface temperature of the form 102 in the optional heating step may be between about 325 K and about 340 K and varies according to the melting point of the powdered wax materials. In one embodiment, the surface temperature of the form 102 in the optional heating step is about 325 K.

Figure 7:
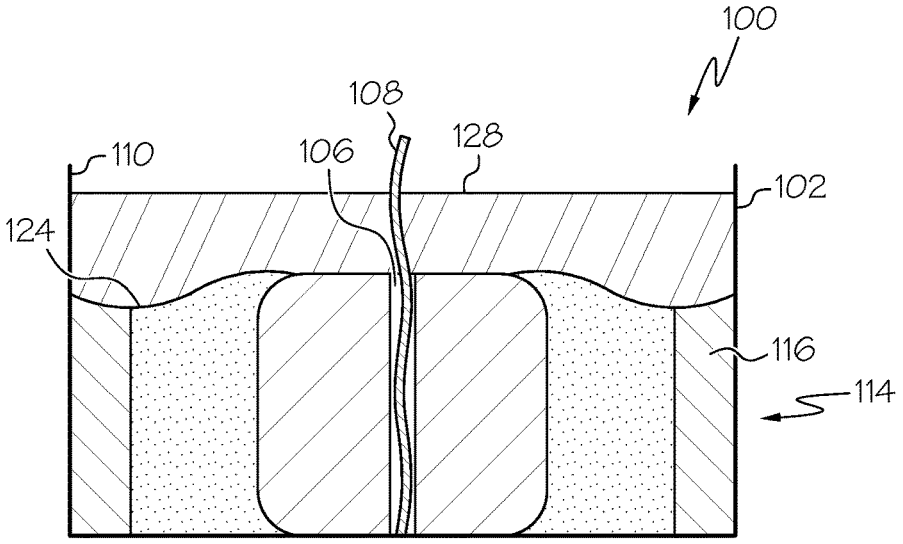
FIG. 7 is a cross-sectional view of the candle assembly of FIG. 6 taken along the line C-C after the solid wax layer has been poured over the powdered wax layer according to one or more embodiments shown and described herein.

Referring now to FIG. 7, a liquefied fuel substance is then poured over the top of the powdered wax layer 114 to form a solid wax layer 128. The solid wax layer 128 may be any suitable fuel substance, including paraffin wax, triglyceride wax such as vegetable wax, tallow, palm wax, soy wax, coconut oil wax, stearic acid, palmetic acid, apothecary blends, mottling wax, slack wax, a blend thereof, or other suitable fuel substance. The solid wax layer 128 may have a second color and/or a second scent component. The solid wax layer 128 is initially in a molten, liquid form and is poured over the top of the powdered wax layer 114 to cap and seal the candle assembly 100. It should be understood that the pouring process may be designed to provide different surface finishes, including cold pour, slurried, mottled, apothecary, or other suitable candle surface finish. The cold pour surface finish may be achieved by cooling the sidewalls 110 of the form 102 prior to pouring the solid wax layer 128. The slurried surface finish may be achieved by cooling the solid wax layer 128 to a temperature around its melting temperature and then pouring the solid wax layer 128 over the interface surface 124 of the powdered wax layer 114. The mottled surface finish may also be achieved by utilizing a solid wax layer 128 comprising a fully refined paraffin wax or a wax with additives suitable for achieving a mottled presentation. The solid wax layer 128 generally has a melting point in the range of 315 K to 335 K, and in one embodiment, the melting point of the solid wax layer 128 is slightly lower than the melting point of the powdered wax layer 114 so that the contours of the interface surface 124 are not disturbed upon addition of the molten solid wax layer 128. However, the melting point of the solid wax layer 128 may be reasonably close to the melting point of the powdered wax layer 114 to achieve a balanced burning effect in the finished candle assembly 100. Thereafter, the candle assembly 100 is allowed to cool until the solid wax layer 128 is formed.

Figure 8:
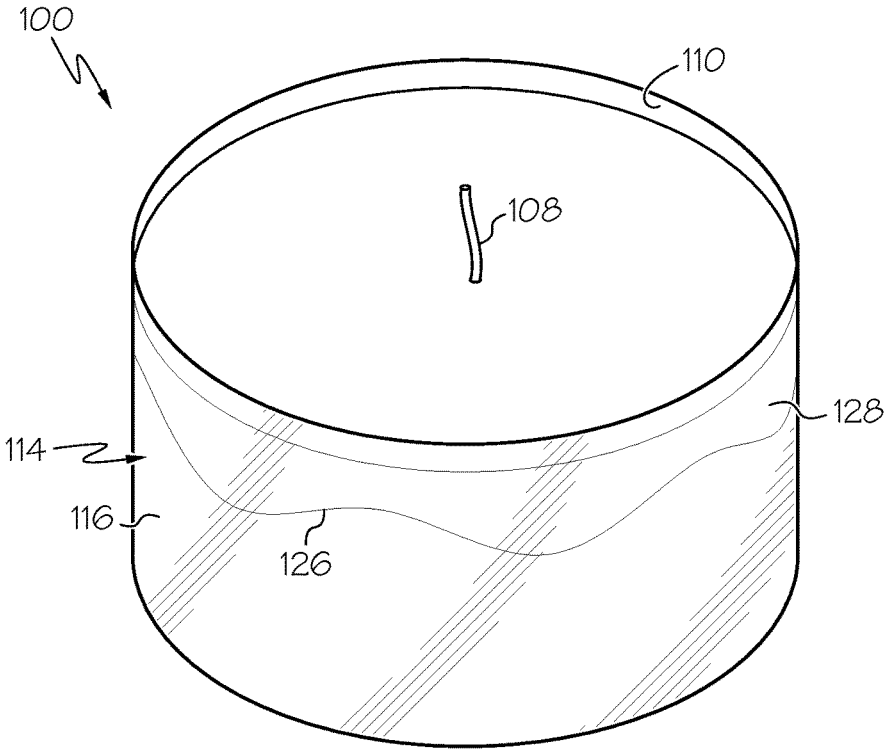
FIG. 8 is a side view of the candle assembly of FIG. 7 that includes a freestanding container, wick, compressed outer region of the powdered wax layer, and poured solid wax layer according to one or more embodiments shown and described herein.

Referring now to FIG. 8, a completed candle assembly 100 according to the embodiment of FIGS. 1-7 is shown. The candle core 104 is completely surrounded by the powdered wax layer 114 and is no longer visible. In this embodiment, the solid wax layer 128 completely covers the powdered wax layer 114. The non-horizontal pattern of the outer perimeter 126 of the interface surface 124 of the compressed outer region 116 of the powdered wax layer 114 is visible to an observer in the finished candle assembly 100 through the sidewalls 110 of the form 102. Specifically, the non-horizontal interface surface 124 and the non-horizontal outer perimeter 126 of interface surface 124, create a non-horizontal, visible interface between the outer region 116 of the powdered wax layer 114 and the solid wax layer 128. The wick 108 is embedded in the candle core 104 and attached to the bottom of the form 102. The wick 108 protrudes through the solid wax layer 128.

In the embodiment of the candle assembly 100 schematically depicted, there is one powdered wax layer 114 and one solid wax layer 128 situated on top of the powdered wax layer 114. However, it should be understood that other embodiments are possible and contemplated. For example, in an alternative embodiment (not shown), multiple compressed powdered wax layers and solid wax layers may be utilized and alternated to form a candle assembly.

As noted above, in one embodiment, the powdered wax layer 114 has a first color or, alternatively, a first combination of colors. The solid wax layer 128 has a second color or, alternatively, a second combination of colors. In some embodiments, the first color or first combination of colors of the powdered wax layer 114 is different than the second color or second combination of colors of the solid wax layer 128. The color or combination of colors of each layer is achieved through the use of an added colorant, which may be present between 0% to 0.65% by weight in the powdered wax layer 114 and solid wax layer 128. In one embodiment, the colorant is soluble in the materials comprising the powdered wax layer 114 or solid wax layer 128. However, in other embodiments, it should be understood that non-soluble colorants may also be used in small quantities. Suitable colorants include, without limitation, Cobalt Blue Dye Flake #DF12019, Scarlet Red Dye Flake DF20001, Violet Dye Flake DF23349, and/or blends thereof.

As noted above, in one embodiment, the powdered wax layer 114 has a first scent component or, alternatively, a first combination of scent components and the solid wax layer 128 has a second scent component or, alternatively, a second combination of scent components. In some embodiments, the first scent component or first combination of scent components of the powdered wax layer 114 is different than the second scent component or second combination of scent components of the solid wax layer 128. The scent component may be present between 0 to 12% by weight of the materials comprising the powdered wax layer 114 and the solid wax layer 128. In one embodiment, the scent component or combination of scent components of the powdered wax layer 114 is present at 0 to 3% by weight of the materials comprising the powdered wax layer 114. In one embodiment, the scent component or combination of scent components of the solid wax layer 128 is present at 0 to 5% by weight of the materials comprising the solid wax layer 128. The scent components may include fragrances, essential oils, odor eliminating agents, odor neutralizing agents, citronella, blends thereof, or other suitable scent components. In yet another embodiment, the powdered wax layer 114 and/or the solid wax layer 128 may be unscented and not include any scent components or combinations of scent components.

Figure 9:
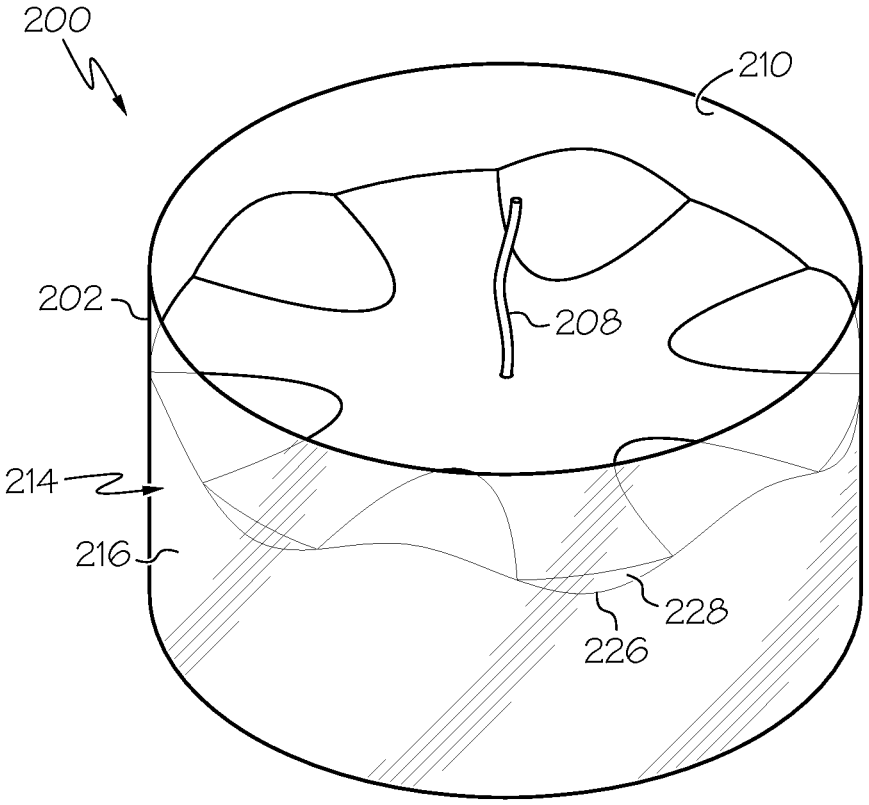
FIG. 9 is a cross-sectional view of a finished candle assembly according to another embodiment wherein portions of the powdered wax layer extend above the solid wax layer according to one or more embodiments shown and described herein.

Referring now to FIG. 9, a completed candle assembly 200 according to another embodiment is shown. The candle assembly 200 is formed similarly to the embodiments described herein. In this embodiment, the candle assembly 200 comprises a form 202, a wick 208, a powdered wax layer 214, and a solid wax layer 228. The outer region 216 of the powdered wax layer 214 is compressed to form an interface surface 224. The pattern of the interface surface 224 and, more specifically, the outer perimeter 226 of the interface surface 224, creates a visible, non-horizontal interface between the powdered wax layer 214 and subsequent layers added to the candle assembly 200. Liquefied wax is then poured over the powdered wax layer 214 to form the solid wax layer 228. In this embodiment, the solid wax layer 228 does not completely cover the powdered wax layer 214 and portions of the outer region 216 of the powdered wax layer 214 protrude above the solid wax layer 228. The non-horizontal pattern of the interface surface 224 of the compressed outer region 216 of the powdered wax layer 214 is still visible to an observer in the finished candle assembly 200 through the sidewalls 210 of the form 202.

While the candle assemblies are described herein as comprising a separate candle core around which the powdered wax layer is deposited, it should be understood that, in alternative embodiments, the candle core may be omitted, such as when a wick is inserted directly into a channel formed in the powdered wax layer.

EXAMPLES

The embodiments described herein will be further clarified by the following non-limiting hypothetical examples.

Example 1

In this hypothetical example, a candle having a poured or apothecary look is achieved. A freestanding container is utilized. The freestanding container is made of transparent glass having a cylindrical shape. A candle core made of paraffin wax is centrally positioned in the container, and a wick is threaded through the channel of the candle core. The wick is a braided, cotton wick.

A powdered wax layer is loaded into the cylindrical container. The powdered wax layer surrounds the candle core. A sufficient volume of the materials comprising the powdered wax layer is added such that the powdered wax layer occupies about 75% of the total volume of the cylindrical container. The powdered wax layer comprises a paraffin triglyceride blend. The powdered wax layer is created through the use of a cooling tower and has a particle size of about 250 μm. The majority of the powdered wax layer particles are spherical with an aspect ratio of 1. The powdered wax layer has a melting point of about 325 K. The powdered wax layer does not have an added colorant. The powdered wax layer does not have an added scent component.

The molding tool is constructed from polyvinyl chloride. It is cylindrical and matches the internal dimensions of the cylindrical container. The molding tool includes a channel to accommodate the wick and avoid compressing the wick. The molding tool has a non-horizontal compression face with a wave pattern characterized by deep troughs and high crests. The molding tool is mechanically driven. The molding tool is inserted in the container to compress the outer region of the powdered wax layer. After compression, the cylindrical container is heated briefly at a temperature at which the surface temperature of the sidewall of the container is about 330 K to melt any errant powdered wax layer particles on the sidewall of the container. The outer region of the powdered wax layer now has an interface surface and corresponding outer perimeter complimentary to the compression face of the molding tool with deep troughs and high crests and is visible to an observer through the transparent glass of the container.

The solid wax layer is then poured over the top of the powdered wax layer. The solid wax layer comprises an apothecary blend. The solid wax layer has a melting point of about 320 K. The solid wax layer has a blue color, achieved through the addition of Cobalt Blue Dye Flake #DF12019. The Cobalt Blue Dye Flake #DF12019 is present at 0.65% by weight of the solid wax layer. The solid wax layer does not have a scent component.

The solid wax layer covers the top of the powdered wax layer, but the top of the crests of the wave pattern of the compressed outer region of the powdered wax layer protrudes slightly above the solid wax layer. The candle assembly is allowed to cool until the solid wax layer has solidified.

Example 2

In this hypothetical example, a candle having a granular look is achieved. A freestanding container is utilized. The freestanding container is made of transparent plastic having a square shape. Four candle cores made of paraffin wax are grouped together in a square configuration and are centrally positioned in the square container. A wick is threaded through the channels of each of the candle cores. The wicks are braided, cotton wicks.

A powdered wax layer is loaded into the square container. The powdered wax layer surrounds the candle cores. A sufficient volume of the materials comprising the powdered wax layer is added such that the powdered wax layer occupies about 50% of the total volume of the square container. The powdered wax layer comprises a paraffin triglyceride blend. The powdered wax layer is created through the use of a spray drum and has a particle size of about 2 mm. The majority of the powdered wax layer particles will ideally be spherical with an aspect ratio of 1, but the use of the spray drum will likely lead to a more flat, flake-like shape. The powdered wax layer has a melting point of about 325 K. The powdered wax layer does not have an added colorant. The powdered wax layer has a scent component that is odor neutralizing.

The molding tool is constructed from polyvinyl chloride. It has a square shape and matches the internal dimensions of the square container. The molding tool includes a channel to accommodate the wicks and avoid compressing the wicks. The molding tool has a non-horizontal compression face with a wave pattern characterized by elongated, shallow waves. The molding tool is mechanically driven. The molding tool is inserted in the container to compress the outer region of the powdered wax layer. After compression, the cylindrical container is heated briefly at a temperature at which the sidewall of the container is about 330 K to melt any errant powdered wax layer particles on the sidewall of the container. The outer region and corresponding perimeter of the powdered wax layer now has an interface surface complimentary to the molding tool with elongated, shallow waves and is visible to an observer through the transparent plastic of the container.

The solid wax layer is then poured over top of the powdered wax using a cold pour technique. The solid wax layer comprises a paraffin blend. The solid wax layer has a melting point of 325 K. The solid wax layer is allowed to cool until it is a slurry, and is poured over the top of the powdered wax layer. The cold pour is ideal because the solid wax layer and the powdered wax layer have identical melting points. The solid wax layer has a purple color, achieved through the addition of Violet Dye Flake DF23349. The Violet Dye Flake DF23349 is present at 0.65% by weight of the solid wax layer. The solid wax layer has a scent component and is odor neutralizing. The scent component is present at 5% by weight of the solid wax layer.

The solid wax layer completely covers the powdered wax layer. The solid wax layer is poured in a sufficient volume to ensure that it extends upward from and completely caps the highest point of the powdered wax layer, while still leaving sufficient space before the upper edge of the square container. The candle assembly is allowed to cool until the solid wax layer has solidified.

Example 3

In this hypothetical example, a candle having multiple and alternating powdered wax layers and solid wax layers is achieved. A freestanding container is utilized. The freestanding container is transparent glass having a rectangular shape. Two candle cores made of paraffin wax are positioned at each end of the container, equidistant from the center point, and with enough distance from the sidewall of the rectangular container to allow the powdered wax and solid wax to surround each candle core. A wick is threaded through the channel of each candle core. The wick is a braided, cotton wick.

A first powdered wax layer is loaded into the rectangular container. The first powdered wax layer surrounds the candle cores. A sufficient volume of the materials comprising the first powdered wax layer is added such that the first powdered wax layer occupies about 25% of the total volume of the rectangular container. The first powdered wax layer comprises a paraffin triglyceride blend. The first powdered wax layer is created through the use of a cooling tower and has a particle size of about 250 μm. The majority of the first powdered wax layer particles are spherical with an aspect ratio of 1. The first powdered wax layer has a melting point of 330 K. The first powdered wax layer does not have an added colorant. The first powdered wax layer has a scent component and is odor neutralizing. The scent component is present at 3% by weight of the powdered wax.

The molding tool is constructed from polyvinyl chloride. It is rectangular and matches the internal dimensions of the rectangular container. The molding tool includes a channel to accommodate the wicks and avoid compressing the wicks. The molding tool has a non-horizontal compression face with a wave pattern characterized by short, shallow waves. The molding tool is mechanically driven. The molding tool is inserted in the container to compress the outer region of the first powdered wax layer. After compression, the cylindrical container is heated briefly at a temperature at which the surface temperature of the sidewall of the container is 330 K to melt any errant powdered wax layer particles on the sidewall of the container. The outer region and corresponding outer perimeter of the first powdered wax layer now has an interface surface complimentary to the molding tool with short, shallow waves and is visible to an observer through the transparent glass of the container.

A first solid wax layer is then poured over the top of the powdered wax layer. The first solid wax layer comprises an apothecary blend. The first solid wax layer has a melting point of about 320 K. The first solid wax layer has a red color, achieved through the addition of Scarlet Red Dye Flake DF20001. The Scarlet Red Dye Flake DF20001 is present at 0.65% by weight of the first solid wax layer. The first solid wax layer does not have a scent component.

The first solid wax layer covers the top of the first powdered wax layer, but only at a volume that occupies yet another 25% of the rectangular container. The candle assembly is allowed to cool until the first solid wax layer has solidified.

A second powdered wax layer is then added. The second powdered wax layer is comprised of the same material as the first powdered wax layer. A sufficient volume of the materials comprising the second powdered wax layer is added such that the second powdered wax layer occupies another 25% of the total volume of the rectangular container. The outer region of the second powdered wax layer is compressed in the same manner and with the same molding tool as provided for the outer region of the first powdered wax layer. The outer region and corresponding outer perimeter of the second powdered wax layer now has an interface surface complimentary to the molding tool with short, shallow waves and is visible to an observer through the transparent glass of the container.

A second solid wax layer is then added to cover the top of the second powdered wax layer. The second solid wax layer is comprised of the same material as the first solid wax layer. The second solid wax layer is poured in a sufficient volume to ensure that it extends upward from and completely caps the highest point of the second powdered wax layer, while still leaving sufficient space before the upper edge of the rectangular container. The candle assembly is allowed to cool until the second solid wax layer has solidified.

It should now be understood that the candle assemblies described herein generally include a form, at least one candle core, at least one layer of powdered wax wherein the outer region is compressed, and at least one layer of solid wax. It should also now be understood that the methods of making such candle assemblies described herein generally include positioning at least one candle core in a form; loading the form with at least one layer of powdered wax and compressing the outer region of the at least one layer of powdered wax with a molding tool having a non-horizontal compression face to form the interface surface of the outer region of the at least one layer of powdered wax into a similar non-horizontal interface surface, the outer perimeter of which is visible to an observer in the finished candle assembly; and pouring at least one layer of liquefied fuel substance to form a solid wax layer over the at least one layer of powdered wax. It should be further understood that the candle assemblies and methods of forming such candle assemblies may also include the at least one powdered wax layer having a first color or first combination of colors and a first scent component or first combination of scent components and the at least one solid wax layer having a second color or second combination of colors and a second scent component or second combination of scent components.

The embodiments described herein provide unique aspects including candle assemblies that are aesthetically distinct and have enhanced visual and aromatic properties and methods of forming those candle assemblies that are more efficient and result in aesthetically distinct candle assemblies with enhanced visual and aromatic properties.

It will be apparent to those skilled in the art that various modifications and variations can be made to the embodiments described herein without departing from the spirit and scope of the disclosure. Thus, it is intended that the embodiments described herein cover the modifications and variations of this disclosure provided they come within the scope of the appended claims and their equivalents.

What is claimed is:

1. A layered candle assembly, the layered candle assembly comprising:

a form comprising at least one sidewall;

at least one candle core positioned in the form such that the at least one candle core is spaced apart from the at least one sidewall of the form to create a space therebetween;

at least one wick;

at least one layer of powdered wax positioned between the at least one candle core and the at least one sidewall and occupying the space therebetween, the at least one layer of powdered wax comprising an outer region and an inner region, the outer region being positioned adjacent to the at least one sidewall and the inner region being positioned adjacent to and radially inward from the outer region, the outer region of the at least one layer of powdered wax being compressed more than the inner region of the at least one layer of powdered wax; and at least one layer of solid wax positioned over the at least one layer of powdered wax.

2. The layered candle assembly of claim 1, wherein the at least one candle core comprises paraffin wax, triglyceride wax such as vegetable wax, tallow, or blends thereof.

3. The layered candle assembly of claim 1, wherein the at least one candle core comprises at least one channel with the at least one wick threaded through the at least one channel.

4. The layered candle assembly of claim 1, wherein the at least one layer of powdered wax has a first color and a first scent component and the at least one layer of solid wax has a second color that is different from the first color and a second scent component that is different from the first scent component.

* * * * *